United States Patent [19]

Patel et al.

[11] 4,147,268

[45] Apr. 3, 1979

[54] PILFER-PROOF CLOSURE FOR CONTAINERS

[76] Inventors: Chandrakant S. Patel; Rashmikant S. Patel, both of 17 D, Nandanvan Society, Baroda-5, Gujrat, India

[21] Appl. No.: 726,114

[22] Filed: Sep. 24, 1976

[51] Int. Cl.[2] ..... B65D 41/34

[52] U.S. Cl. ..... 215/252; 215/258; 215/253

[58] Field of Search ..... 215/252, 253, 258, 318, 215/317

[56] References Cited

U.S. PATENT DOCUMENTS

| | | | |
|---|---|---|---|
| 3,329,295 | 7/1967 | Fields | 215/252 |
| 3,673,761 | 7/1972 | Leitz | 215/253 |
| 3,737,064 | 6/1973 | Patel | 215/258 |
| 3,901,403 | 8/1975 | Menke | 215/258 |
| 3,924,769 | 12/1975 | Fillmore | 215/253 |

FOREIGN PATENT DOCUMENTS

| | | | |
|---|---|---|---|
| 2356007 | 11/1973 | Fed. Rep. of Germany | 215/252 |
| 2508388 | 2/1975 | Fed. Rep. of Germany | 215/252 |

*Primary Examiner*—Ro E. Hart

*Attorney, Agent, or Firm*—Schuyler, Birch, Swindler, McKie & Beckett

[57] ABSTRACT

A pilfer-proof closure for use in combination with a standard container having a threaded neck portion and a collar below said threaded portion, comprising a body having an internally threaded upper portion followed by a lower skirt portion for protecting a flexible locking member attached to the inside of the body by frangible connectors situated on the outside circumference of the locking member. The locking member extends partially below the skirt portion so that it may be easily viewed. The skirt, however, extends past the frangible connectors to protect the connectors from tampering and severing. The flexible locking member carries a top surface which engages beneath the collar when the closure is threaded onto the container. When the closure is unthreaded from the container, the frangible connecting means are broken to completely disconnect the locking member from the threaded portion of the closure. The flexible locking member in one embodiment comprises an annular ring having a plurality of locking hooks which slope across the locking ring in a direction which is the same as that of the screw threads in the upper threaded portion of the closure so that the closure may be easily removed from its forming apparatus by unscrewing.

8 Claims, 9 Drawing Figures

PILFER-PROOF CLOSURE FOR CONTAINERS

BACKGROUND OF THE INVENTION

1. Field of the Invention

This invention relates generally to closures for containers and, more particularly, to a pilfer-proof closure adapted for use with the conventional screw threads of a standard container, such as a bottle.

2. Description of the Prior Art

The prior art is replete with various types of closures for containers having means to indicate whether the closure has been tampered with. Such pilfer-proof closures may comprise a body having an upper threaded portion and a lower depending skirt portion which protects a locking ring that is connected by frangible means to the main body of the closure. However, the locking rings of the prior art pilfer-proof closures generally abut against a specially formed flange on the neck of a container and cannot be adapted for use with the conventional necks on standard containers. For example, U.S. Pat. No. 3,737,064, issued to the applicant, shows a locking ring which must abut against a protruding annular flange on the neck of the container, and hence is of no value for standard containers.

In addition, the locking elements of many of the prior art closures require relatively complex die forming equipment in order to form the various flanges needed. Generally, once the flanges have been formed, the dies must be collapsible in order to release the closure from the forming mandrel as taught by U.S. Pat. No. 3,329,295 to Fields. Still other of the prior art closures must be completely broken to indicate tampering and cannot thereafter be reused to close the container.

SUMMARY OF THE INVENTION

Accordingly, it is an object of the present invention to provide a pilfer-proof closure having an upper threaded portion and a lower skirt portion, which is adapted to be used on the screw threads of a standard container such as a bottle or other similar device.

A further object of the present invention is to provide a pilfer-proof closure having a lower skirt portion for protecting a flexible locking member attached to the inside of the body by frangible connectors and extending partially below the skirt portion for easy viewing.

It is a further object of the present invention to provide a pilfer-proof closure which can be reused after the container has been initially opened.

An additional object of the present invention is to provide a pilfer-proof closure which can be easily and quickly removed from its forming apparatus without damage to the closure and without the need for expensive and complicated forming equipment.

Briefly, the present invention accomplishes the foregoing and other objects by providing a pilfer-proof closure for a standard neck container having an upper threaded portion and a lower skirt portion integrally connected thereto. A flexible locking member is connected to the lower edge of the threaded portion of the closure by means of frangible connectors situated on the outside circumference of the locking members and is spaced inwardly a small distance from the skirt portion. The locking member extends below the lower edge of the skirt portion to give an indication of whether or not the container has been tampered with. However, the skirt portion extends to a point below that of the frangible connectors to protect such connectors from deliberate tampering or accidental severing. Therefore, an indication of whether or not the container has been tampered with is easily provided merely by seeing whether or not the locking member is still integrally connected to the threaded portion of the closure.

The locking member in a preferred embodiment comprises an annular plastic ring having a plurality of locking hooks spaced on its inner surface. Each locking hook slopes downwardly across the inner surface of the locking ring in the same direction as that of the internal threads on the threaded portion of the closure to, in effect, form a continuation of the internal screw threads. This feature enables a completed closure to merely be unscrewed from a forming mandrel after the forming operation without danger of breaking the frangible connectors for the locking member.

The locking hooks in cross section include a top surface which is adapted to fit underneath a locking collar on the container's neck. The closure and all its elements may be formed from polypropylene or high density polyethylene and the thin material of the locking ring between the locking hooks insures that the locking ring will expand sufficiently to slide down over the locking collar on the container when the closure is being applied to the container. However, any unscrewing of the closure after it has been applied to the container will cause the frangible connecting means to be severed and the locking member to fall down around the neck of the container by virtue of the engagement of the top surface of the locking hooks and the locking collar on the container.

The locking member may comprise, in an alternative embodiment, an annular ring having a single continuous locking rib applied to the inner surface of the ring along its circumference, the closure together with the locking member being preferably formed of a high flexibility, low density polymer to render it expansible to slip over the locking collar. The locking member may additionally have various configurations for the locking hooks, including horizontal and spherical hooks, and also various annular elements for mounting the locking hooks, including a plastic ribbon and thread, rather than the annular ring.

BRIEF DESCRIPTION OF THE DRAWINGS

The novel features of the invention are set out with particularity in the appended claims, but the invention will be understood more fully and clearly from the following detailed description of the preferred embodiment as set forth in the accompanying drawings in which:

BRIEF DESCRIPTION OF THE PREFERRED EMBODIMENT

Figure 1:
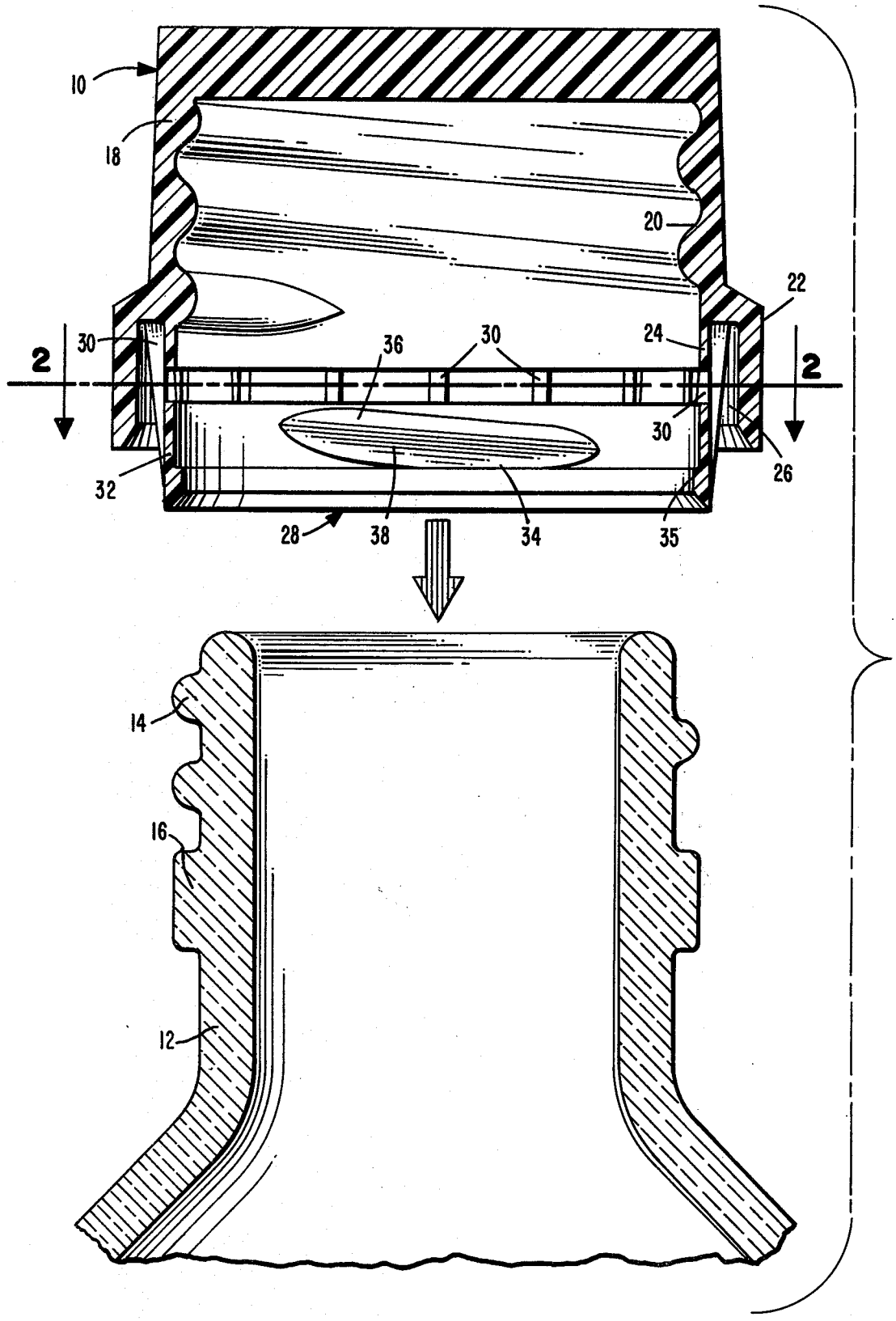
FIG. 1 is a cross-sectional view of the closure according to one embodiment of the present invention and the neck of the container to which it is to be applied, the closure being shown before being applied to the container neck.
Figure 2:
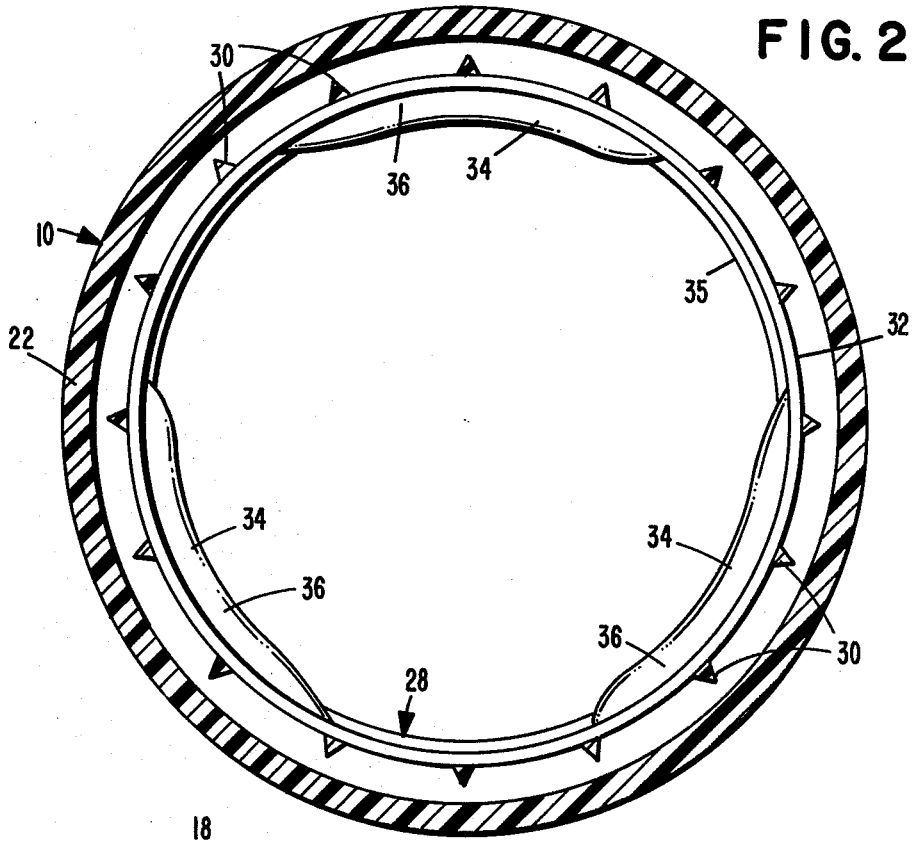
FIG. 2 is a cross-sectional view on line 2—2 of FIG. 1.

Referring now to the drawings, a pilfer-proof closure 10 is illustrated for use with the neck 12 of a standard container, such as a bottle, whose lower portion is not shown but may be of any suitable shape. The neck 12 of the bottle has a threaded portion 14 adjacent its upper end and a locking collar 16 immediately therebelow as is conventional. The locking collar 16 may have the same radial thickness as the threads 14 on the neck 12 of the bottle as shown in FIGS. 1–4, or the locking collar 16 may be suitably tapered outwardly in a downward direction. However, the amount of the taper on the collar 16 would be very slight so that the collar at its lower end would have a nominally greater radial thickness than the collar at its upper end, the radial thickness of the collar still being approximately that of the screw threads 14. The bottle may be conventionally formed from glass or plastic, or may be made from any other suitable material.

Referring now to the closure 10 itself, the closure 10 is comprised of a body 18 having an internally threaded upper portion 20 with an integrally connected lower skirt portion 22. The lower skirt portion 22, annular in shape, is of a slightly greater diameter than the upper portion 20 of the closure and depends from the upper portion 20 in a downwardly direction. The internal threads on the upper portion 20 of the closure 10 are shaped to mate with the conventional screw threads 14 on the container. An annular flange 24 is also integrally connected with the upper portion 20 of the closure, the flange 24 being spaced inwardly from the lower skirt portion 22 and depending downwardly in a direction parallel to the skirt 22 to form a radial space 26. However, the flange 24 does not extend the full length of the skirt 22 but terminates at a point well above the bottom edge of the skirt 22.

A locking member shown generally at 28, is releasably attached to the lower edge of the flange 24 by means of a plurality of frangible connectors 30, the connectors 30 being integrally attached between the lower edge of the flange 24 and the outside surface of the locking member 28 so as to be situated on the outside circumference of the locking member. The frangible connectors 30 comprise thin webs which may be easily severed. The locking member 28 is so designed to extend below the bottom edge of the skirt portion 22 of the closure 10 when the locking member 28 is attached to the flange 24 by means of the connectors 30. However, the skirt portion 22 is long enough to extend past and protect the frangible connectors 30. Therefore, it can be appreciated that the locking member 28 can be observed visually to indicate whether the container has been tampered with without the necessity for viewing windows in the skirt portion 22 even though the skirt portion 22 still protects the frangible connectors 30 from tampering or accidental severing.

In the form of the invention shown in the drawings, the locking member 28 comprises an annular ring 32 having a plurality of locking hooks 34 integrally formed on the inside surface of the ring 32 adjacent the upper end thereof. Three such locking hooks 34 are shown spaced at equal distances around the periphery of the ring 32 although the number and spacing of such hooks could be varied as desired. The annular ring 32 has a reinforcement flange 35 molded to its inner surface adjacent the bottom end of the ring 32.

Figure 3:
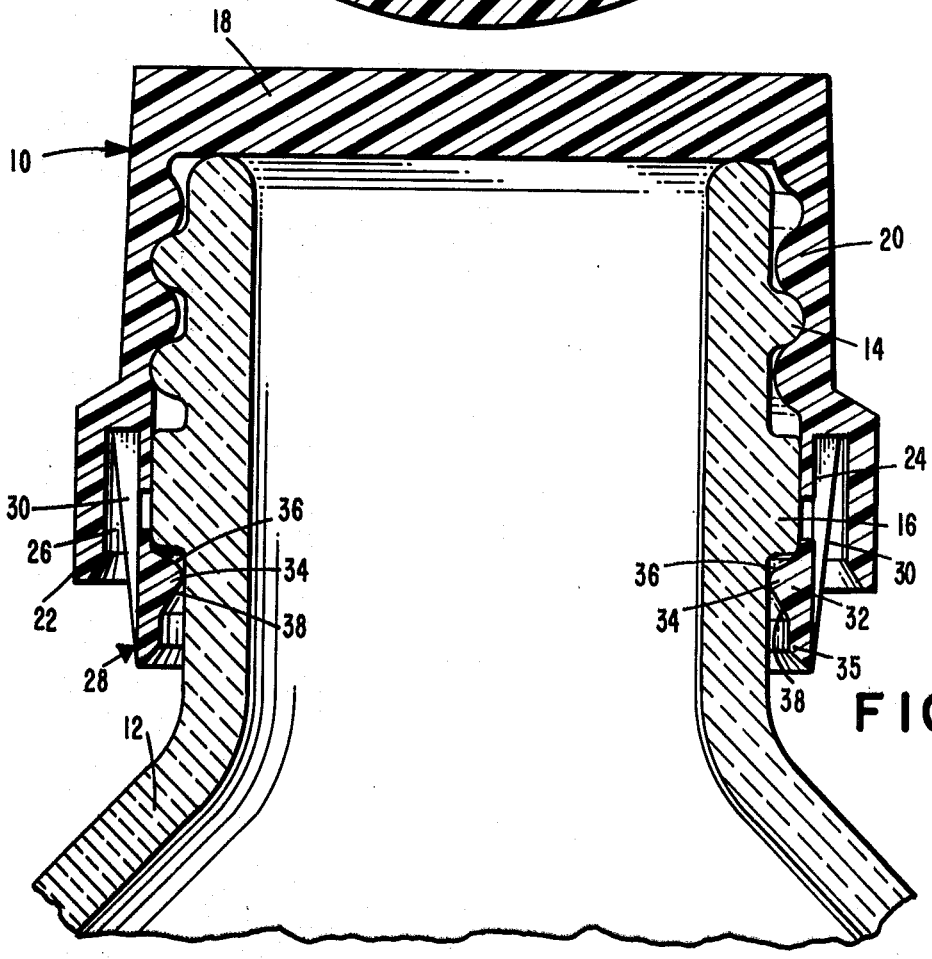
FIG. 3 is a cross-sectional view of the closure according to one embodiment of the present invention mounted on the neck of a container.
Figure 4:
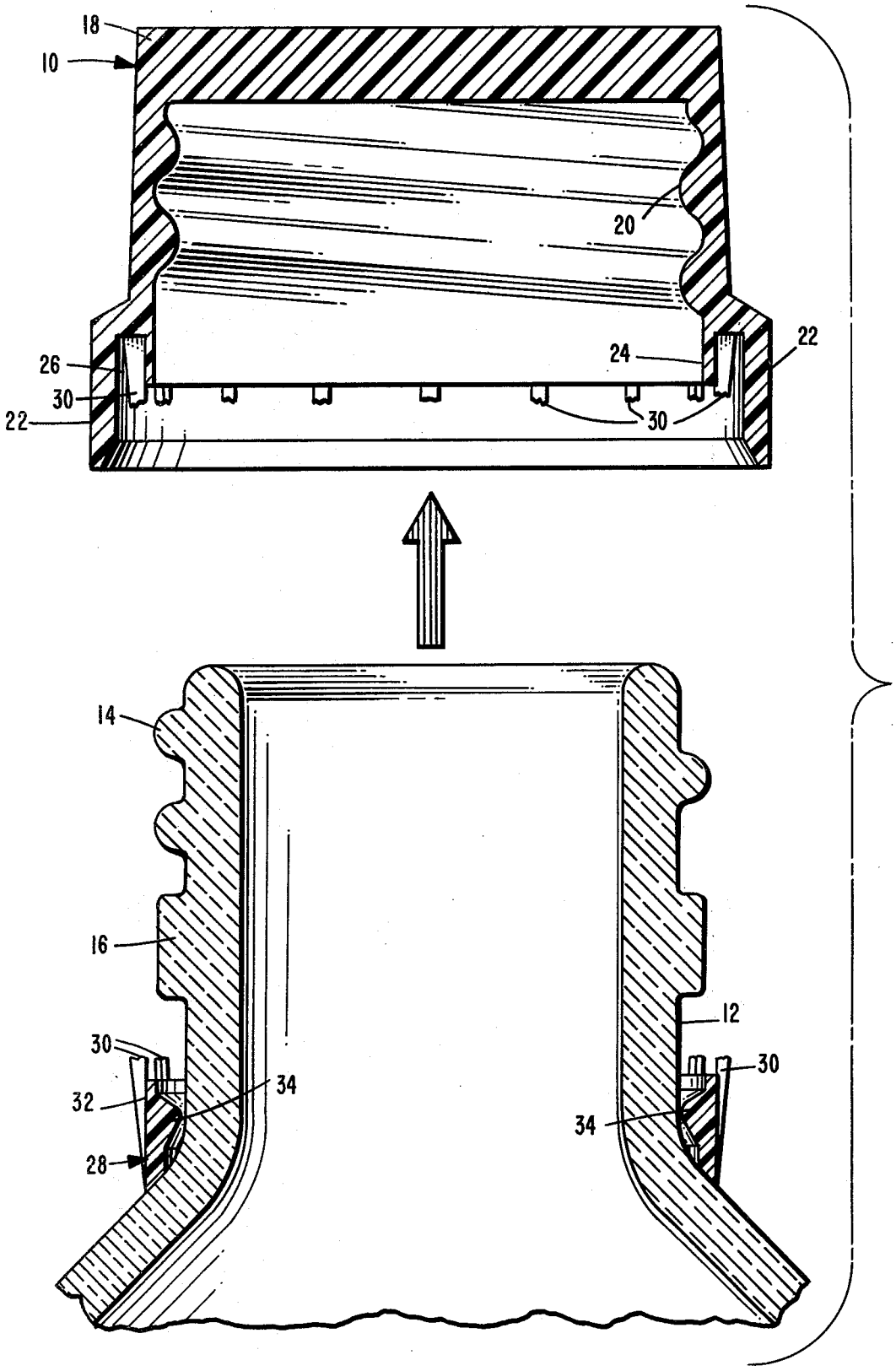
FIG. 4 is a cross-sectional view of the closure according to one embodiment of the present invention and the neck of a container, the closure being shown after being removed from the container neck.

As shown in FIG. 1, each locking hook 34 traverses a short segment of the circumference of the ring 32 and has a slight downward direction of travel equal to the direction of the threads on the internal surface of the upper portion 20 of the closure 10 so that the hooks 34 form a screw thread similar to that in the upper portion 20. Referring to FIGS. 1, 3 and 4, each locking hook 34 in cross section comprises a top surface 36 which slopes outwardly in a downward direction from the inner surface of the ring 32 and a bottom surface 38 which slopes inwardly in a downward direction to subsequently rejoin the inner surface of the ring 32. The top surface 36 of the hook 34, although not horizontal, is sufficiently close to being horizontal to enable the top surface 36 to lock beneath the collar 16 in the neck 12 of the container as will be hereafter described. It can be appreciated that the top surface 36 of the hook 34 could be made horizontal if so desired.

The closure 10 and all its elements may be molded in a single operation from a semi-rigid, low flexibility plastic material such as high density polyethylene or polypropylene. In the locking member 28 shown in FIGS. 1–4, the annular ring 32 may comprise a thin film of nominal thickness, approximately 0.3 mm. The thin and flexible material of the annular ring 32 extending between each of the locking hooks 34 enables the locking ring 32 to expand sufficiently to get down over the locking collar 16 on the neck 12 of the container when the closure 10 is first applied to the bottle in a manner to be described subsequently.

Figure 5:
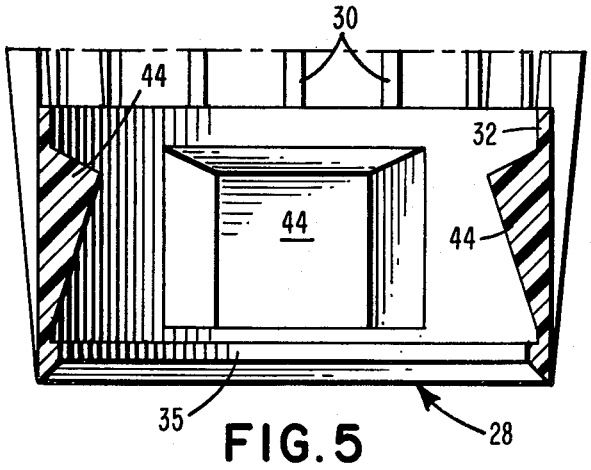
FIGS. 5–9 are cross-sectional views of alternative embodiments of the locking member of the closure according to the instant invention.
Figure 6:
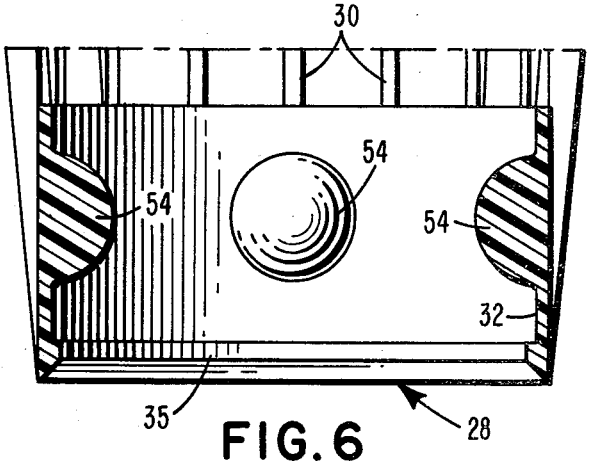

FIGS. 5 and 6 disclose two alternative embodiments for the locking member 28 illustrated in FIGS. 1–4 in which the downwardly sloping locking hooks 34 have been replaced by locking hooks 44 which extend horizontally across the annular ring 32 or by spherically shaped locking hooks 54, respectively, the hooks 44 and 54 protruding inwardly from the annular ring 32. It should be understood that the hooks 34, 44 or 54 may be of any design and shape provided that they engage the bottom surface of the locking collar 16 on the standard container as will be described in more detail hereafter.

Figure 7:
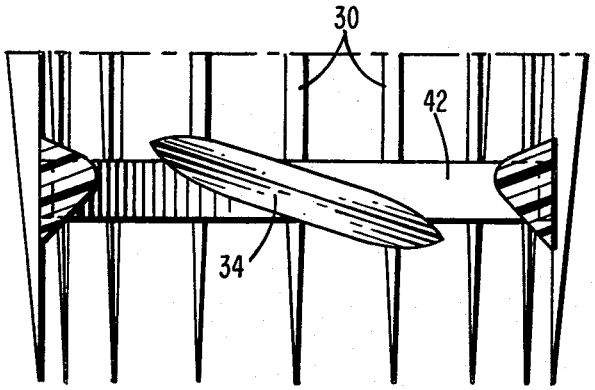
Figure 8:
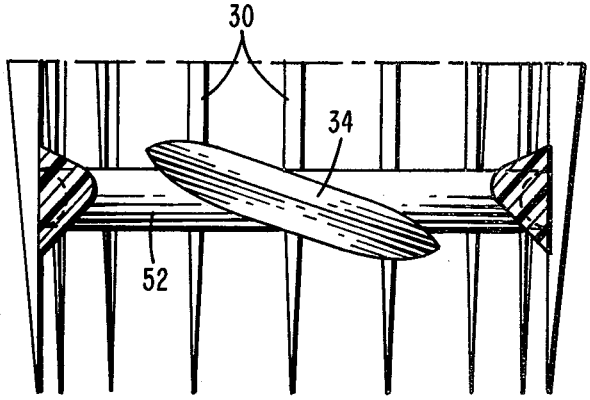

Other alternatives to the locking member 28 shown in FIGS. 1–4 are illustrated in FIGS. 7 and 8. These embodiments include the downwardly sloped locking rings 34 shown in FIGS. 1–4, but these hooks 34 are no longer mounted on the thin annular ring 32. Instead, a thin plastic ribbon 42 in FIG. 7 or a thin circular plastic thread or "O-ring" 52 (FIG. 8) are employed to extend between adjacent locking hooks 34 to impart the necessary flexibility and the annular shape to the locking member 28. The locking hooks 34 shown in FIGS. 7 and 8 may also be the locking hooks 44 and 54 shown in FIGS. 5 and 6.

Figure 9:
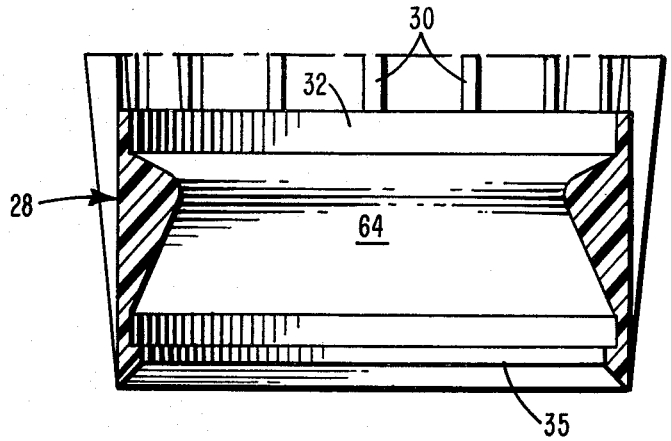

Another alternative to the locking member 28 shown in FIGS. 1–4 is illustrated in FIG. 9. In this embodiment, a single continuous annular locking rib 64, having the same or a similar cross section as that of the locking hooks 34, 44 or 54, extends circumferentially around the entire circumference of the annular ring 32. In such an alternative embodiment for the locking member 28, the material of the locking member 28 would preferably be of a low density, high flexibility plastic material in order to give the ring a sufficient amount of expansion capability in order to move past the locking collar 16 on the container neck 12 as the closure is applied. When using such a locking member 28, the locking collar 16 on the container would preferably be one which slopes slightly outwardly in a downward direction in a conical manner to assist the continuous annular locking rib 64 in flexing around the locking collar 16.

In the operation of the pilfer-proof closure 10 of the present invention, the closure 10 may be attached to the neck 12 of a standard container simply by screwing the closure 10 onto the threads 14 present on the neck 12 of the container. As the closure 10 is screwed down the neck 12 of the container, the locking member 28 will encounter the locking collar 16 on the container. Because of the construction utilized in FIGS. 1–4, the annular ring 32 will expand over the collar 16 on the neck 12 until the top surfaces 36 of the locking hooks 34 have become engaged underneath the collar 16 as shown in FIG. 3.

To remove the closure 10 from the neck 12 of the container, it is simply necessary to unscrew the threaded portion 20 of the closure 10. As the unscrewing takes place, the frangible connectors 30, which hold the locking member 28 to the flange 24 on the threaded portion 20, will be severed by the bottom surface of the locking collar 16 acting against the top surfaces 36 of the locking hooks 34 on the ring 32. Thus, as the closure 10 is unscrewed from the container, the locking member 28 will be broken off from the threaded portion 20 of the closure 10 and will be left around the neck 12 of the container as shown in FIG. 4. The remaining portion of the closure 10 may then be screwed back on the threads 14 to reclose the container as necessary. The method of operation for the locking member 28 utilizing only a single annular rib on the annular ring will be similar to that just described with the top surface of the rib engaging beneath the collar 16.

From the foregoing, it can be appreciated that the closure 10 of the present invention, when installed on the neck 12 of a standard container, gives an indication of whether or not the bottle has been tampered with merely by viewing whether or not the locking member 28 is still connected with the threaded portion 20 of the closure 10, for once the locking member 28 has been severed from the threaded portion 20 by someone opening the closure 10, there is no way to reattach the frangible connectors 30 to make the closure 10 whole. Thus, the condition of the locking member 28 gives an immediate indication of whether the contents of the container have been tampered with.

Furthermore, the feature of the instant invention is providing that the top surface of the locking member 28, i.e., surface 36 in FIGS. 1–4, have the same downward slope as the threads 14 on the inner surface of the top portion 20 of the closure 10 is particularly advantageous. This is so because it enables the entire closure 10 to be formed by a suitable process, such as injection molding, in a single operation. When the closure 10 has been so formed, it may be easily removed from the forming apparatus by merely unscrewing the entire closure 10 from the conventional mandrel of the forming apparatus. Because the locking surface on the locking member 28 forms part of the screw threads, the unscrewing operation can take place without fracturing the frangible connectors 30 and without damaging any of the parts of the closure 10.

The frangible connectors do not interfere with this unscrewing operation since they are formed on the outside of the locking ring 32 and do not impede the inner surface of the locking ring 32 from being unscrewed from the forming mandrel. Such an arrangement is particularly advantageous because less complicated and less costly forming equipment can be used, and the forming operation is somewhat simpler than if various kinds of contractible or collapsible mandrels have to be used in order to contract and clear the locking ribs on the formed closure.

The closure 10 of the present invention may be made leak-proof by inserting a plug or similar gasket material in the top of the closure 10 above the internally threaded portion 20. It may be appreciated that the shape of the skirt portion 22 of the closure shown herein is illustrative only and may be varied as desired as long as it protects the frangible connectors 30 but does not obstruct viewing of at least the bottom portion of the locking member 28.

Although the present invention has been illustrated in terms of a preferred embodiment, it will be obvious to one of ordinary skill in the art that numerous modifications may be made without departing from the true spirit and scope of the invention and that the scope of the invention is to be limited only by the appended claims.

We claim:

1. A pilfer-proof closure for use in combination with a standard container having a threaded neck portion and a collar below said threaded portion comprising:

a body having an internally threaded portion and a lower skirt portion;

a flexible locking member spaced inwardly from said skirt portion, said locking member adapted to slide over the collar as the closure is threaded onto the container;

said locking member having a top surface adapted to engage the bottom surface of the collar to lock the closure in place when the closure is completely threaded onto the container;

frangible connecting means for releasably securing said locking member to the inside of said body, whereby said frangible connecting means will be severed by the collar acting on said top surface when the closure is unthreaded from the container to disconnect said locking member from said body; and said top surface extending across said locking member in a downward direction equal to the direction of the threads on said internally threaded portion so that the closure may be unscrewed from its forming apparatus without severing said frangible connecting means.

2. A pilfer-proof closure as defined in claim 1 wherein said frangible connecting means extend between said threaded portion at one end and the outside surface of said locking member at the other end.

3. A pilfer-proof closure as defined in claim 1 wherein said flexible locking member extends below the lower edge of said skirt portion to give an indication of tampering.

4. A pilfer-proof closure as defined in claim 1 wherein said skirt portion is adapted to extend past and protect said frangible connecting means.

5. A pilfer-proof closure as defined in claim 1 wherein said locking member comprises a thin annular ring having a plurality of integral spaced locking hooks thereon, and said top surface comprises the top surface of said hooks.

6. A pilfer-proof closure as defined in claim 5 wherein said ring and said hooks are formed of a high density plastic material.

7. A pilfer-proof closure as defined in claim 5 wherein said ring includes a reinforcing flange adjacent its bottom edge.

8. A pilfer-proof closure as defined in claim 5 wherein said ring is formed of a plastic material and is approximately 0.3 mm thick.

* * * * *